US011624155B2

(12) United States Patent
Chiang et al.

(10) Patent No.: US 11,624,155 B2
(45) Date of Patent: Apr. 11, 2023

(54) POROUS SUBSTRATE WITH POROUS NANO-PARTICLES STRUCTURE AND PRODUCTION METHOD THEREOF

(71) Applicant: National Taiwan University of Science and Technology, Taipei (TW)

(72) Inventors: Wei-Hung Chiang, Taipei (TW); Yi-Jui Yeh, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 781 days.

(21) Appl. No.: 16/594,531

(22) Filed: Oct. 7, 2019

(65) Prior Publication Data

US 2021/0062427 A1 Mar. 4, 2021

(30) Foreign Application Priority Data

Aug. 30, 2019 (TW) ..... 108131237

(51) Int. Cl.

| | |
|---|---|
| ***B22F 9/14*** | (2006.01) |
| ***D21H 19/38*** | (2006.01) |
| ***B22F 9/24*** | (2006.01) |
| ***D21H 19/06*** | (2006.01) |
| ***D21H 19/44*** | (2006.01) |
| ***D21H 27/00*** | (2006.01) |
| ***D21H 27/08*** | (2006.01) |

(52) U.S. Cl.

CPC ..... *D21H 19/38* (2013.01); *B22F 9/14* (2013.01); *B22F 9/24* (2013.01); *D21H 19/06* (2013.01); *D21H 19/44* (2013.01); *D21H 27/002* (2013.01); *D21H 27/08* (2013.01); *B22F 2301/255* (2013.01); *B22F 2301/35* (2013.01); *B22F 2304/054* (2013.01)

(58) Field of Classification Search

None

See application file for complete search history.

(56) References Cited

U.S. PATENT DOCUMENTS

2011/0281267 A1* 11/2011 Carbone ..... B01L 3/5027 977/773
2012/0214666 A1* 8/2012 van den Hoek ..... B82Y 40/00 502/313
2014/0132376 A1* 5/2014 Jin ..... C22C 19/07 75/346

FOREIGN PATENT DOCUMENTS

KR 102131887 B1 * 7/2020

OTHER PUBLICATIONS

English translation of KR 10-2131887 B1 (originally published Jul. 8, 2020) obtained from PE2E search.*

(Continued)

*Primary Examiner* — George Wyszomierski

(74) *Attorney, Agent, or Firm* — Alan D. Kamrath; Karin L. Williams; Mayer & Williams PC

(57) ABSTRACT

In the porous substrate loaded with porous nano-particles structure and one-step micro-plasma production method thereof, since the micro-plasma system enhances the electron density and promotes reaction speed in the reaction without generating thermal effect, the method may be performed at an atmosphere environment. The nano-particles also can be quickly obtained by aforementioned micro-plasma system. The electromagnetic field generated by the micro-plasma can drive the nano-particles to be loaded onto the porous substrate in a one step, rapid and low cost process to improve the conventional techniques which require a relatively long procedure time and a complicated process.

10 Claims, 8 Drawing Sheets

(56) References Cited

OTHER PUBLICATIONS

Zhang, R-C, et al., "Gold nanoparticle-polymer nanocomposites synthesized by room temperature atmospheric pressure plasma and their potential for fuel cell electrocatalytic application", Scientific Reports 7:46682, Published Apr. 24, 2017.*

Merche, D. et al., "Synthesis and/or grafting of noble metal nanoparticles by microplasma and by atmospheric plasma torch", HAL Open Science Id:01702634, Submitted Feb. 7, 2018.*

* cited by examiner

POROUS SUBSTRATE WITH POROUS NANO-PARTICLES STRUCTURE AND PRODUCTION METHOD THEREOF

FIELD OF INVENTION

The present invention generally relates to a substrate loaded with nano-particles structure, and more particularly it relates to a porous substrate loaded with nano-particles having 3D porous structure and production method thereof.

The present invention has been developed primarily to be a material enable of creating Surface Enhanced Raman Spectroscopy (SERS) effect and will be described hereinafter with reference to this application. However, it will be appreciated that the invention is not limited to this particular field of use.

BACKGROUND OF THE INVENTION

Metal nano-particle has an important impact on modern science and technology. It is widely used and has great value in many fields. Nowadays, various methods for metal atomization are well-developed due to mature studies of atomic spectroscopy. These methods are able to precisely control a generation speed of metal steam and a flow rate of carrying gas. Atomization source being utilized in these methods can be directly provided by equipments like flame atomizer, electrothermal atomizer or glow discharge atomizer. In addition, argon emission, field emission, electron beam method or laser ablation are often used as a solid medium for atomizing metals.

One of the various applications of aforementioned nano-particle is to load the nano-particle onto a substrate. Physical adsorption, soaking, three dimensional printing (3D printing) or chemical vapor deposition are some conventional techniques for loading the nano-particles on the substrate. These techniques normally require at least two steps in the procedure comprising synthesis of the nano-particles and loading on the substrate afterward. These processes are considered complicated and time consuming. Hence, it is eager to have a rapid and one-step process for producing porous substrate loaded with porous nano-particles structure that will overcome or substantially ameliorate at least one or more of the deficiencies of a prior art, or to at least provide an alternative solution to the problems.

It is to be understood that, if any prior art information is referred to herein, such reference does not constitute an admission that the information forms part of the common general knowledge in the art.

SUMMARY OF THE INVENTION

In order to solve shortcomings of conventional techniques for loading the nano-particles on the substrate that is relatively complicate and time consuming, the present invention is required.

According to a first aspect of the present invention, a substrate loaded with nano-particles structure is provided with having: a porous substrate; a porous nano-particles structure loaded on the porous substrate; and the porous nano-particles structure comprise multiple nano-particles.

In accordance with a second aspect of the present invention, further provided is a production method of the substrate loaded with nano-particles structure having steps of: placing a porous substrate between a metal electrode and a micro plasma device or under the micro plasma device in a micro plasma reaction tank; wherein: at least partial metal electrode is immersed into a reaction liquid carried by the micro plasma reaction tank and multiple nano-particles with positive charge are produced in the reaction liquid, and the micro plasma device has set a distance from a surface of the reaction liquid; and introducing a plasma gas into the micro plasma device and outputting a plasma steam towards the surface of the reaction liquid; and multiple nano-particles with positive charge are reduced into multiple nano-particles and loaded on surface of a porous substrate in the reaction liquid.

In accordance, the present invention has the following advantages:

1. Micro plasma process has characteristics of promoting reaction with improving electro-density in a short period without generating thermal effect. This process can rapidly obtain nano-particles by reduction reaction at atmosphere. Further credit to the electromagnetic fields generated by the micro plasma, the nano-particles of the present invention are able to be loaded, attached or deposited on the porous substrate with substantially one-step, low cost and rapid process for solving the problems of complicated and time consuming procedure of the conventional techniques.

2. Compared to the conventional two steps procedures, glass, silicon wafer substrates or pure nano-particles, it is observed for having promoting SERS effect of the porous substrate loaded with porous nano-particles structure in the present invention. The present invention can be utilized in many fields of use like material detection, bio-medication, food safety and environmental pollution monitoring, prevention and control. No strong acid or alkali is required for the production method of the present invention which can be considered as a green process and environmental friendly.

Many of the attendant features and advantages of the present invention will become better understood with reference to the following detailed description considered in connection with the accompanying figures and drawings.

BRIEF DESCRIPTION OF THE DRAWINGS

The steps and the technical means adopted by the present invention to achieve the above and other objects can be best understood by referring to the following detailed description of the preferred embodiments and the accompanying drawings.

FIG. 1 and FIG. 1A are a preferred embodiment of porous substrate loaded with porous nano-particles structure in accordance with the present invention;

DETAILED DESCRIPTION OF THE PREFERRED EMBODIMENTS

Figure 1:
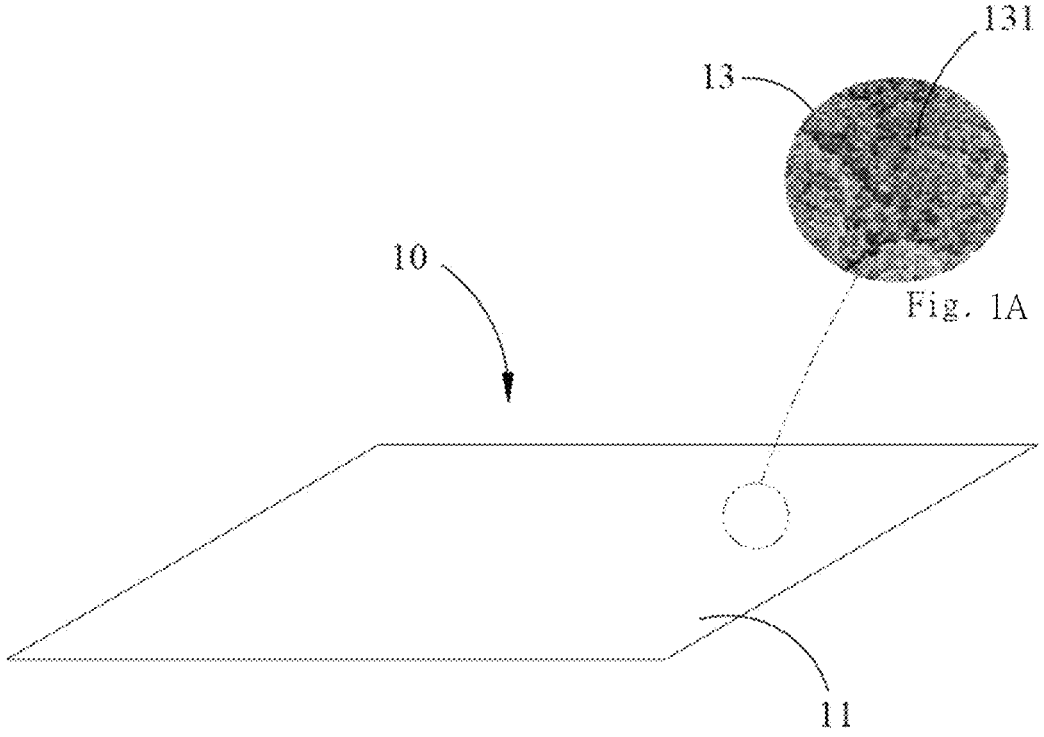

Reference will now be made in detail to the present preferred embodiments of the invention, examples of which are illustrated in the accompanying drawings. Wherever possible, the same reference numbers are used in the drawings and the description to refer to the same or like parts. It is not intended to limit the method by the exemplary embodiments described herein. In the following detailed description, for purposes of explanation, numerous specific details are set forth in order to attain a thorough understanding of the disclosed embodiments. It will be apparent, however, that one or more embodiments may be practiced without these specific details. As used in the description herein and throughout the claims that follow, the meaning of "a", "an", and "the" may include reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to.

[Material and Composition]

Figure 2A:
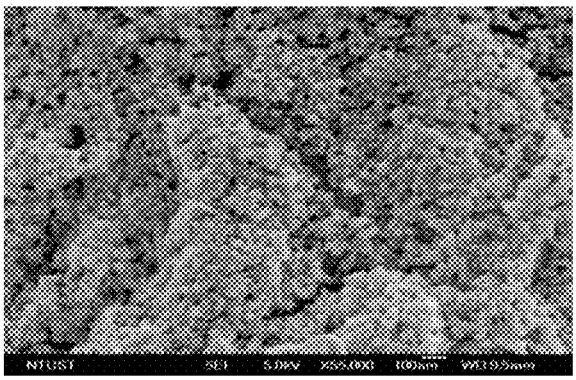
FIG. 2A to FIG. 2F are SEM figures of several preferred embodiments of porous substrate loaded with porous nano-particles structure in accordance with the present invention.
Figure 2B:
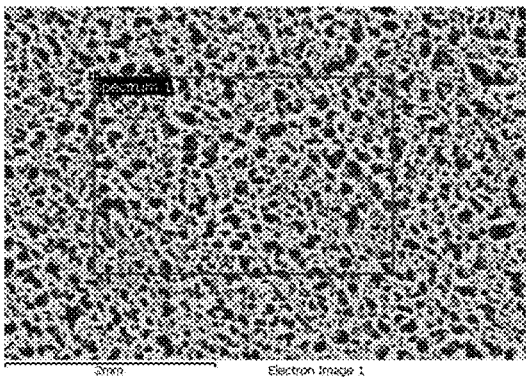
Figure 2C:
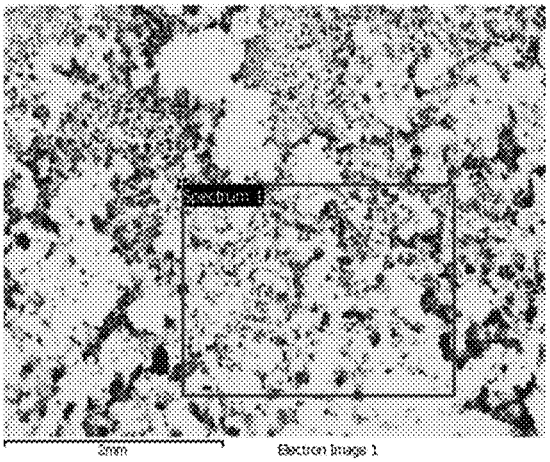
Figure 2D:
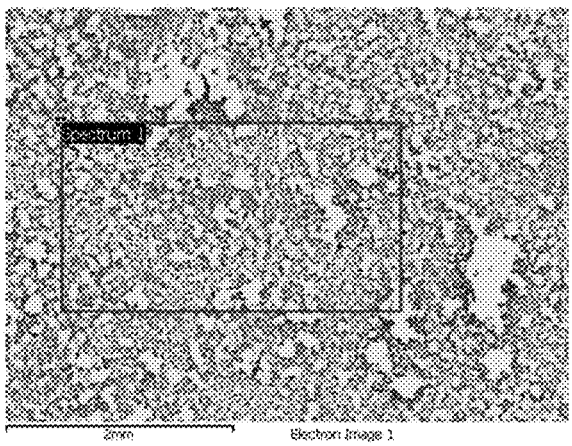
Figure 2E:
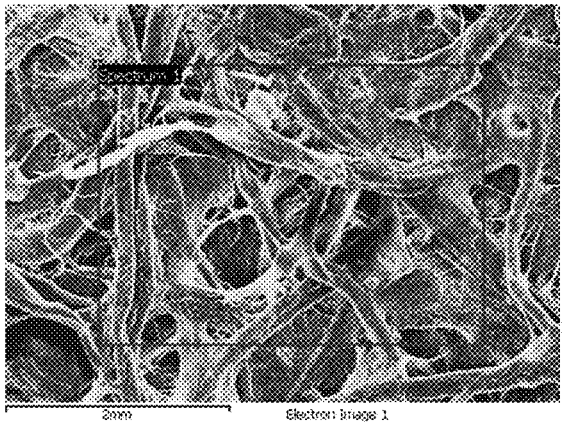
Figure 2F:
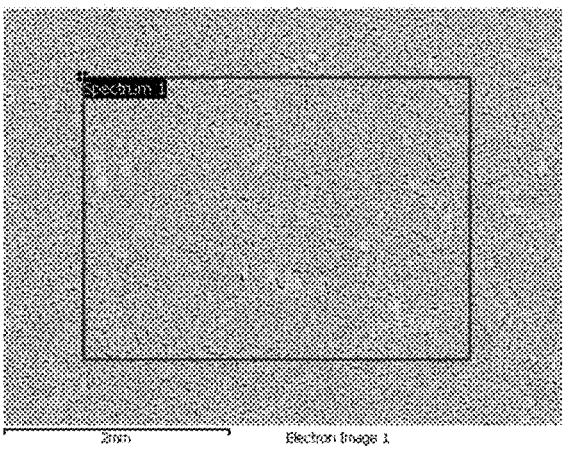
Figure 3:
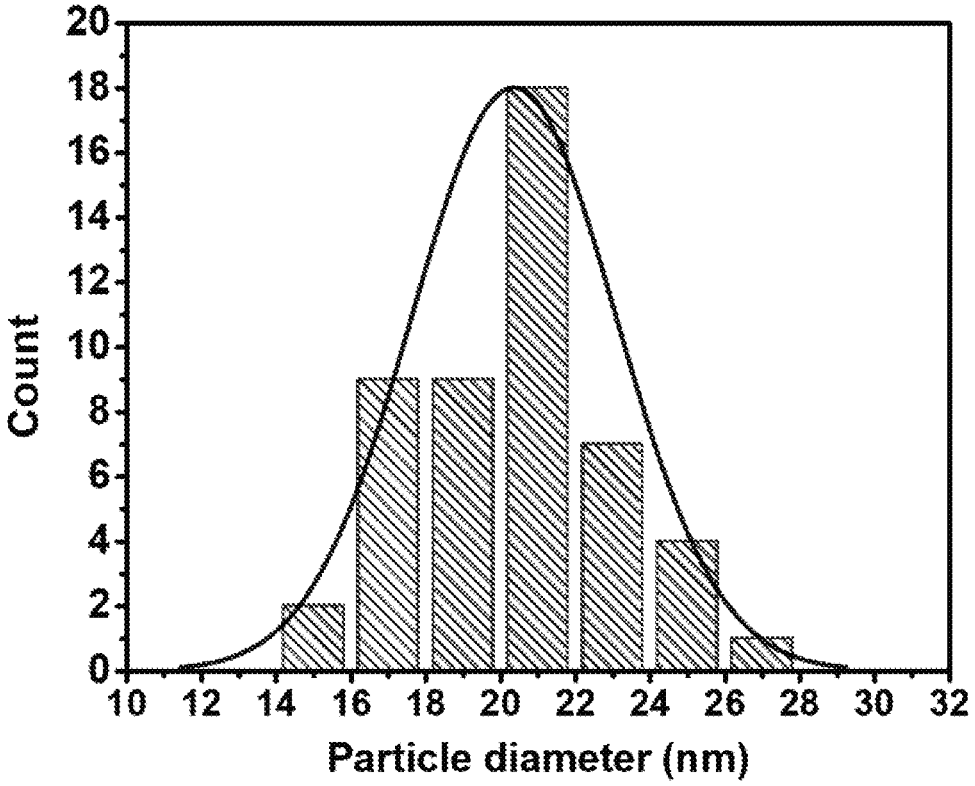
FIG. 3 is a size distribution figure of the nano-particles in accordance with the present invention.

With reference to FIG. 1 and FIG. 1A, a schematic diagram of a preferred embodiment of a porous substrate loaded with porous nano-particles structure 10 of the present invention is provided. The porous substrate loaded with porous nano-particles structure 10 comprises a porous substrate 11 and a nano-particles structure 13 loaded thereon. As shown in FIG. 2A, to FIG. 2F of scanning electron microscope images (SEM), the nano-particles structure 13 comprises multiple nano-particles 131 piled into a porous three dimensional (3D) structure. Material of the nano-particles 131 comprises Sliver (Ag), Iron (Fe) and Gold (Au). With reference to FIG. 2A to FIG. 2B, the nano-particles 131 in these two preferred embodiments are silver nano-particles and the porous substrate 11 are filter paper and mixed cellulose ester porous substrate respectively. With reference to FIG. 2C to FIG. 2D, the nano-particles 131 in these two preferred embodiments are iron nano-particles and the porous substrate 11 are filter paper and mixed cellulose ester porous substrate respectively. With reference to FIG. 2E to FIG. 2F, the nano-particles 131 in these two preferred embodiments are gold nano-particles and the porous substrate 11 are filter paper and mixed cellulose ester porous substrate respectively. Particle size of the nano-particles 131 is preferred to be at a range of 5~50 nm, more preferred to be at a range of 10~25 nm. A size distribution and density of the nano-particles 131 can also be obtained by conversion of the SEM image. As shown in FIG. 3, the particle size of the silver nano-particle in preferred embodiment is at a range of 20.34±2.74 nm. The density of the silver nano-particle in preferred embodiment is at least 1500 particles/$um^2$ or more preferably at least 2000 particles/$um^2$.

Figure 4:
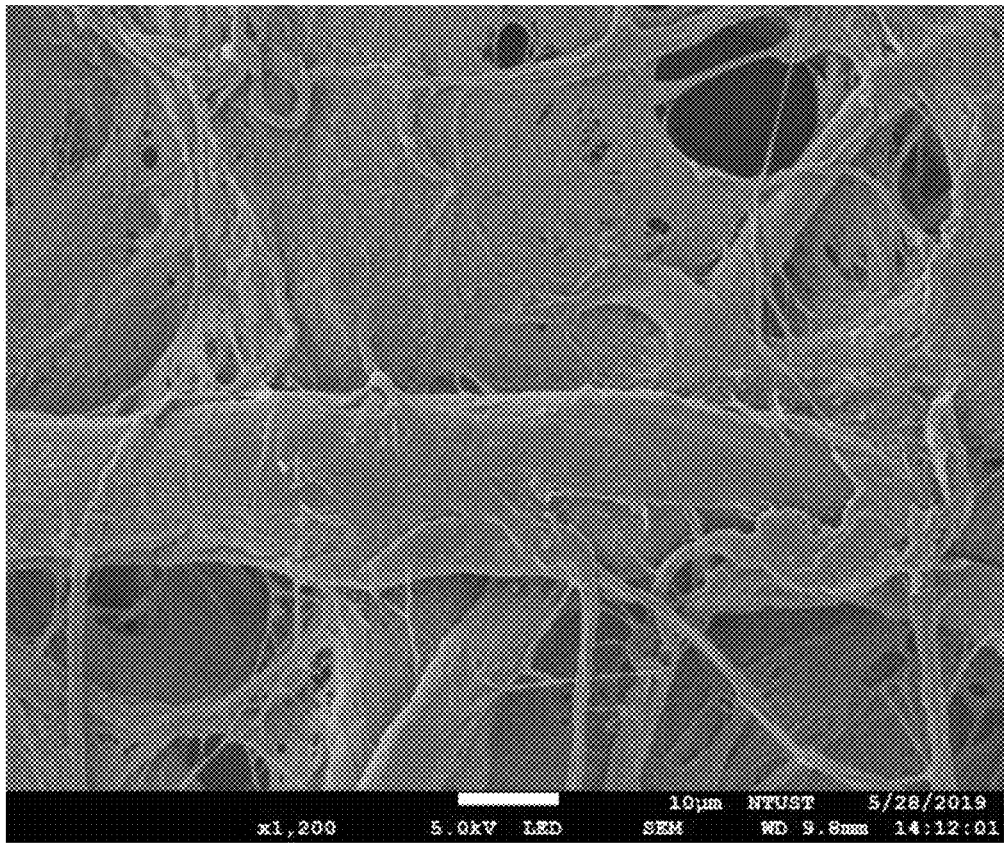
FIG. 4 is a SEM image of the porous substrate in accordance with the present invention.

As shown in FIG. 4, material of the porous substrate 11 includes but not limit to disposable fibrous substrate like paper, filter paper, tissue paper, A4 paper or mixed cellulose ester porous substrate (Advantec®).

[Production Method]

Figure 5:
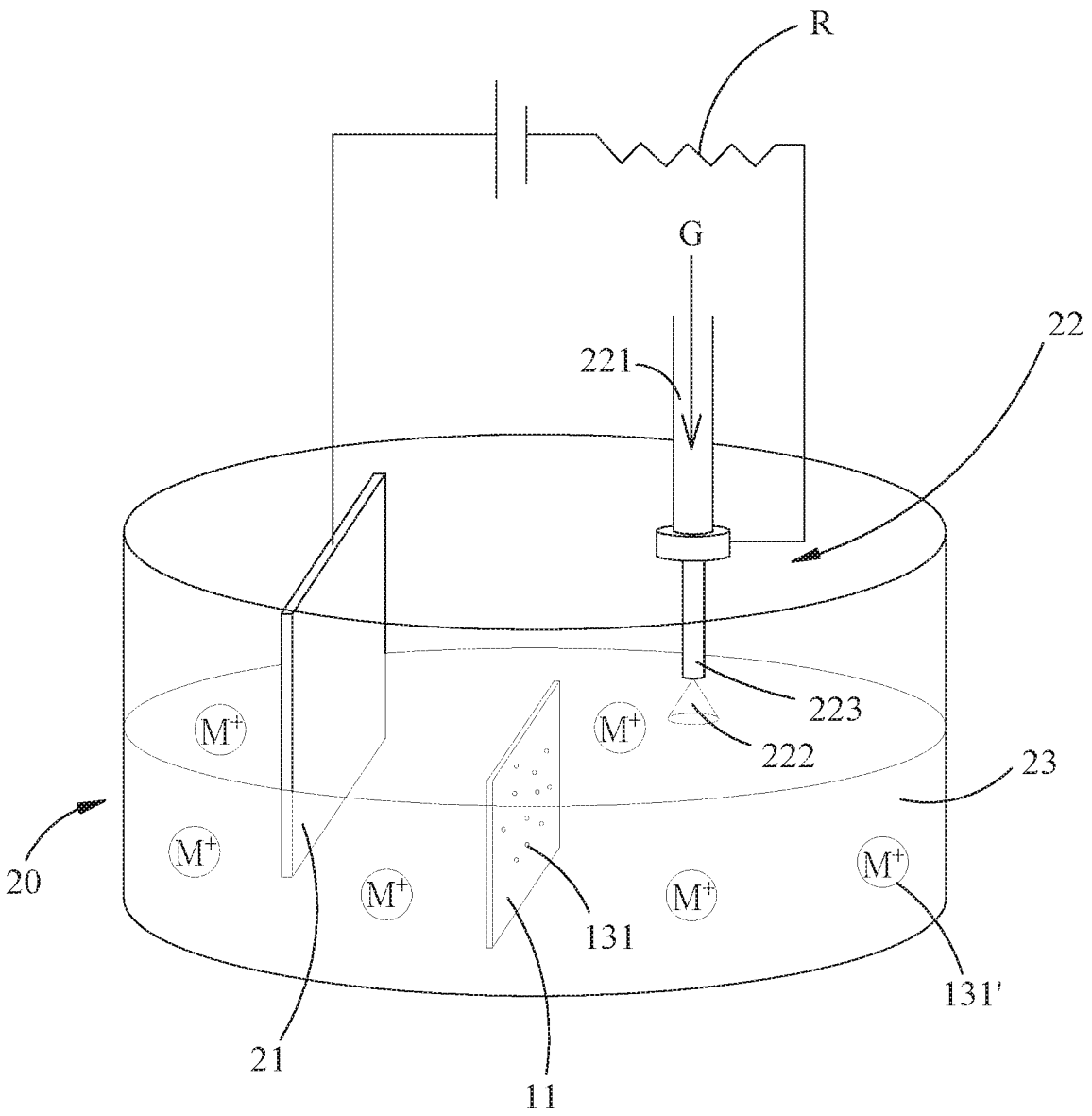
FIG. 5 is a flow diagram of the production method in accordance with the present invention.

Further with reference to FIG. 5, the present invention provides a production method of aforementioned porous substrate loaded with porous nano-particles structure 10 having steps as following.

Step 1: placing the porous substrate 11 between a metal electrode 21 and a micro plasma device 22 or under the micro plasma device 22 in a micro plasma reaction tank 20. At least partial metal electrode 21 is immersed into a reaction liquid 23 carried by the micro plasma reaction tank 20 and multiple nano-particles with positive charge 131' are produced in the reaction liquid 23. The micro plasma device 22 has been set a desired distance from a surface of the reaction liquid 23.

The metal electrode 21 and the micro plasma device 22 are electronic connected and preferably with a resistance R set therebetween. Value of the resistance R is preferred to be at a range of 50~300 kohm or more preferred to be 150 kohm or 160 kohm. The metal electrode 21 and the micro plasma device 22 are electronic connected by direct current (DC) power. Material of the metal electrode 21 includes silver, iron or gold and which it can be considered as a cathode in the reaction liquid 23. The micro plasma device 22 otherwise can be considered as anode in the reaction liquid 23 which it comprises at least a plasma gas inlet 221 and a plasma gas outlet 223. The plasma gas outlet 223 is preferred to be a tube or tube like structure.

The reaction liquid 23 comprises water ($H_2O$), a coating agent and nitric acid ($HNO_3$). The coating agent is able to coat or wrap a certain quantity of the nano-particles after reduction reaction in the reaction liquid 23 which may facilitate the nano-particles 13 be loaded on the porous substrate 11. Material of the coating agent may be but not limited to various saccharides or polymers. The saccharides comprise fructose or glucose. The polymers comprise polyvinyl pyrrolidone (PVP), sodium citrate or trisodium citrate (TSC).

Step 2: introducing a plasma gas G into the plasma gas inlet 221. The plasma gas G will become a plasma stream 222 being applied to the reaction liquid 23 via the plasma gas outlet 223. Multiple nano-particles with positive charge 131' will be reduction to be multiple neutralized nano-particles and deposited or loaded on surface of the porous substrate 11.

Reactions take place by the plasma gas G on the surface of the reaction liquid 23 and the micro plasma device 22 and the metal electrode 21 in the reaction liquid 23 are shown as following equations (1), (2) and (3) wherein symbol "M" in these equations represents metal element of the metal electrode 21. The plasma stream 222 generated from the plasma gas G will generate negative ions and react with the nano-particles with positive charge 131' in the reaction liquid 23. The nano-particle 131 will be obtained by reduction reaction.

$$\text{Surface of the reaction liquid: } Ar+H_2O \rightarrow Ar+H^+ + OH^- \quad (1)$$

$$\text{Micro plasma device: } M^+ + e^- \rightarrow M^0 \quad (2)$$

$$\text{Metal electrode: } M^0 \rightarrow M^+ + e^- \quad (3)$$

Figure 6:
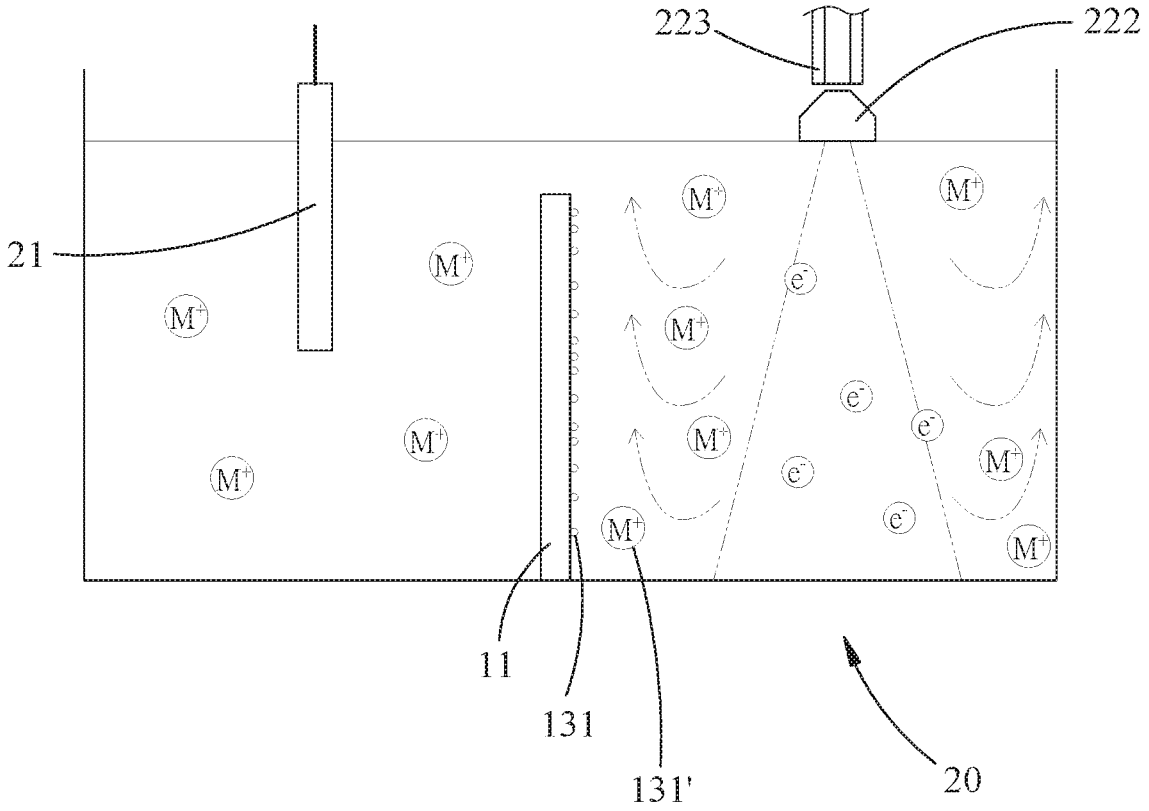
FIG. 6 is a illustration of gas diffusion occurring in the reaction liquid in accordance with the present invention.

With reference to FIG. 6, mechanisms of why the nano-particles can be successfully loaded, attached or deposited on the porous substrate 11 may be electromagnetic, gas diffusion and adsorption. The said gas diffusion is referred to a mechanism where the plasma stream 222 spreads or diffuses outwardly in the reaction liquid 23 and drives the negative ions and the nano-particles with positive charge 131' towards the direction of the porous substrate 11. The nano-particle 131 therefore can be loaded, attached or deposited on the porous substrate 11 and gradually piled into the 3D porous structure thereon. Also, the porous surface of the porous substrate 11 can facilitate the 3D porous structure of the nano-particle 131 won't collapse or drop from it.

In additional, intensity of the plasma steam 222 can be adjusted by physical or chemical parameters of the whole reaction system. The physical parameters include concentration of the coating agent and the nitric acid in the reaction liquid 23. The chemical parameters include intensity of an input current of the micro plasma device 22, distance between the micro plasma device 22 and the surface of the reaction liquid 23 or diameter of the plasma gas outlet 223. For example, if the plasma stream 222 is intended to be increased for promoting the reaction result, it can be achieved by enhancing the input current of the micro plasma device 22, shortening the distance between the micro plasma device 22 and the surface of the reaction liquid 23 or narrowing the diameter of the plasma gas outlet 223. In some preferred embodiments, the distance between the micro plasma device 22 and the surface of the reaction liquid 23 is at a range of 0.05~0.75 cm, or more preferably at a range of 0.1~0.3 cm. The diameter of the plasma gas outlet 223 can be 150~250 um.

The result and condition of the nano-particles 131 loaded, attached or deposited on the porous substrate 11 may be affected by a positioning effect. The positioning effect is referred to where the porous substrate 11 is placed in the reaction liquid 23 during the reaction. At least two positions of the porous substrate 11 can be placed in the reaction liquid 23 which is proven with valid result of loading, attaching or depositing the nano-particles 131. The at least two positions include one of arranging the porous substrate 11 between the metal electrode 21 and the micro plasma device 22 and the other is to arrange the porous substrate 11 beneath the micro plasma device 22. The positioning effect also includes a plane surface of the porous substrate 11 being horizontal or perpendicular to the surface of the reaction liquid 23. After testing, the most promising result can be obtained by the positioning effect of placing the porous substrate 11 between the metal electrode 21 and the micro plasma device 22 at equal distance with the plane surface of the porous substrate 11 being perpendicular to the surface of the reaction liquid 23. At this circumstance, maximum amount of the nano-particles 131 can be evenly loaded, attached or deposited on the porous substrate 11 and formed into stable 3D porous structure.

EXAMPLES

Figure 7A:
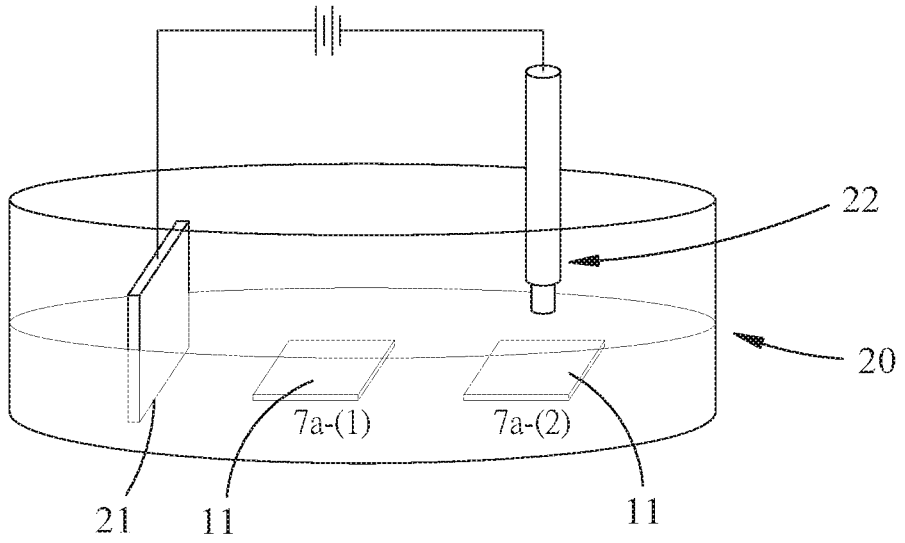
FIG. 7*a* and FIG. 7*b* are illustrations of positioning effects occurring in the reaction liquid in accordance with the present invention.
Figure 7B:
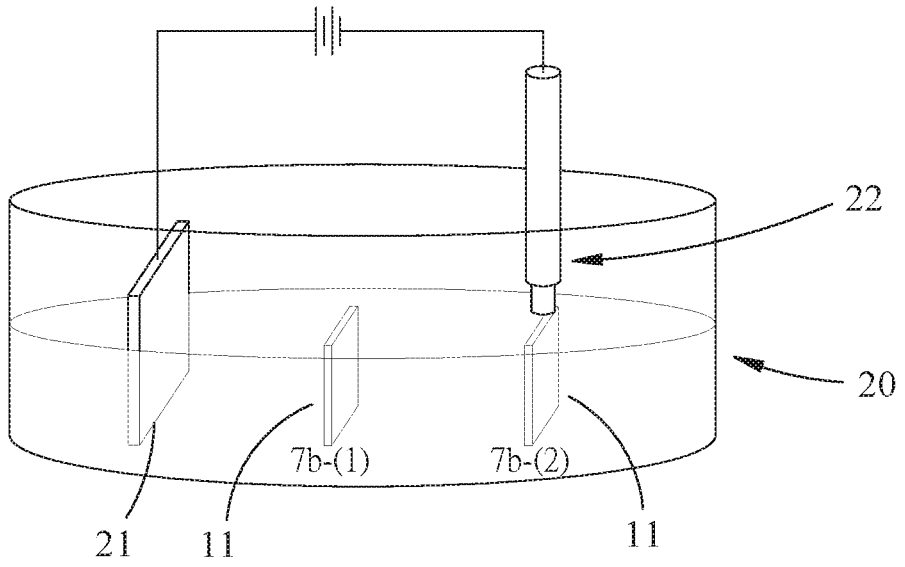

FIG. 7*a* and FIG. 7*b* have illustrated the positioning effects as above described. Reference numbers "7*a*-(1)" and "7*a*-(2)" in the FIG. 7*a* indicate the arrangement of the porous substrate 11 between the metal electrode 21 and the micro plasma device 22 at the equal distance and beneath the micro plasma device 22 with its plane surface horizontal to the surface of the reaction liquid 23. Reference numbers "7*b*-(1)" and "7*b*-(2)" in the FIG. 7*b* indicate the same condition of the porous substrate 11 as FIG. 7*a* but with its plane surface perpendicular to the surface of the reaction liquid 23. The positioning effects referred to "7*a*-(1)", "7*a*-(2)", "7*b*-(1)" and "7*b*-(2)" in FIG. 7*a* and FIG. 7*b* are showed in below chart 1 for measuring surface resistance of the porous substrate 11 after loaded, attached or deposited with the nano-particles 13 with four-point probe. The outcome of the positioning effect in "7*b*-(1)" provides the most promoting result to the present invention.

The embodiments of chart 1 are performed by the system having the metal electrode 21 and the micro plasma device 23 in distance of 3 cm, the micro plasma device 22 apart from the surface of the reaction liquid 23 in distance of 0.3 cm, total reaction time 20 minutes, the argon plasma gas and the silver metal electrode 21. It is to be clearly declared that the aforementioned positions and parameters are only presented as preferred embodiments and are not intended to limit the scope of the present invention. The claimed range of parameters has been all confirmed and valid by the present invention.

CHART 1

| | Position | | | |
|---|---|---|---|---|
| R Value | 7a-(1) | 7a-(2) | 7b-(1) | 7b-(1) |
| Surface resistance | 3.62E−06 | 1.07E−08 | 4.44E−04 | 2.28E−06 |

One of the applications of the porous substrate loaded with porous nano-particles structure 10 in present invention can be used as the enhancement factor of Surface Enhanced Raman Spectroscopy (SERS) of tested material. Normally, the spontaneous Raman scattering is very weak and hard to be identified. By introducing the porous substrate loaded with porous nano-particles structure 10 to the tested material, the present invention is able to enhance signals of Raman scattering and lead to more clearly identification. With reference to below chart 2, it shows SERS test results corresponded to four examples in chart 1. Chart 2 shows that four examples of the present invention all having SERS effect. The outcome of the example "7*b*-(1)" provides the most promoting result to the present invention.

CHART 2

| | Position | | | |
|---|---|---|---|---|
| SERS | 7a-(1) | 7a-(2) | 7b-(1) | 7b-(1) |
| Performance | 1284 | 1634 | 2191 | 891 |

Figure 8:
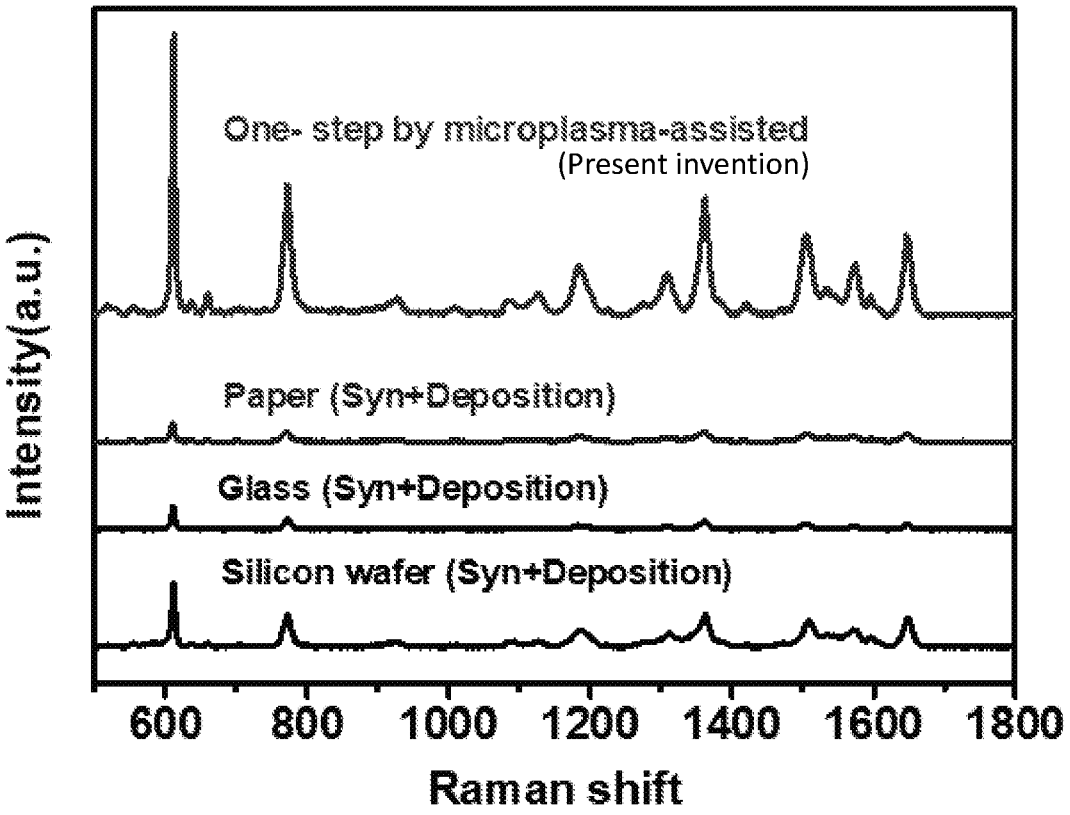
FIG. 8 is a SERS testing result compared with the conventional method and the present invention.

Another feature of the present invention is that the metal nano-particle 131 can be successfully loaded, attached or deposited to the non-conductive porous substrate 11. Comparing to the conventional synthesis and loading method with two processing steps or other type of material of the substrate, the present invention has better performance in SERS effect as shown in FIG. 8 and chart 3 below.

CHART 3

| | Conventional method with two processing steps | | | Present invention Porous substrate |
|---|---|---|---|---|
| Substrate | Silicon wafer | Glass | Paper | (like filter paper) |
| SERS Intensity (611) | 485 | 176 | 142 | 2191.83 |

The above specification, examples, and data provide a complete description of the present disclosure and use of exemplary embodiments. Although various embodiments of the present disclosure have been described above with a certain degree of particularity, or with reference to one or more individual embodiments, those with ordinary skill in the art could make numerous alterations or modifications to the disclosed embodiments without departing from the spirit or scope of this disclosure.

What is claimed is:

1. A production method of a porous substrate with porous nano-particles structure having steps of:

placing a porous substrate between a metal electrode and a micro plasma device or under the micro plasma device in a micro plasma reaction tank; wherein:

at least a part of the metal electrode is immersed into a reaction liquid carried by the micro plasma reaction tank and multiple nano-particles with positive charge are produced in the reaction liquid, and the micro plasma device has a set distance of 0.05~0.75 cm apart from a surface of the reaction liquid; and introducing a plasma gas into the micro plasma device and outputting a plasma stream towards the surface of the reaction liquid; and multiple nano-particles with positive charge are reduced into multiple nano-particles and loaded on surface of the porous substrate in the reaction liquid.

2. The production method as claimed in claim 1, wherein: the porous substrate is placed in the reaction liquid between the metal electrode and the micro plasma device at equal distance.

3. The production method as claimed in claim 2, wherein: a plane surface of the porous substrate is horizontal or perpendicular to the surface of the reaction liquid.

4. The production method as claimed in claim 2, wherein:

the metal electrode and the micro plasma device are electronic connected and a resistance has set therebetween;

material of the metal electrode comprises silver, iron or gold;

the plasma gas comprises argon; and the reaction liquid comprises water, a coating agent and nitric acid; wherein the coating agent comprises saccharides or polymers.

5. The production method as claimed in claim 1, wherein: a plane surface of the porous substrate is horizontal or perpendicular to the surface of the reaction liquid.

6. The production method as claimed in claim 2, wherein: the micro plasma device comprises a plasma gas inlet and a plasma gas tubular outlet.

7. The production method as claimed in claim 6, wherein: a diameter of the plasma gas outlet is at a range of 150~250 um.

8. The production method as claimed in claim 1, wherein: the micro plasma device comprises a plasma gas inlet and a plasma gas outlet.

9. The production method as claimed in claim 8, wherein: a diameter of the plasma gas outlet is at a range of 150~250 um.

10. The production method as claimed in claim 1, wherein:

the metal electrode and the micro plasma device are electronic connected and a resistance has set therebetween;

material of the metal electrode comprises silver, iron or gold;

the plasma gas comprises argon; and the reaction liquid comprises water, a coating agent and nitric acid; wherein the coating agent comprises saccharides or polymers.

* * * * *